US006656599B2

(12) United States Patent
Grossman et al.

(10) Patent No.: US 6,656,599 B2
(45) Date of Patent: Dec. 2, 2003

(54) PROTECTIVE COATING ON METAL

(75) Inventors: David G. Grossman, Corning, NY (US); Kamjula P. Reddy, Corning, NY (US); Michael H. Wasilewski, Corning, NY (US)

(73) Assignee: Corning Incorporated, Corning, NY (US)

( * ) Notice: Subject to any disclaimer, the term of this patent is extended or adjusted under 35 U.S.C. 154(b) by 14 days.

(21) Appl. No.: 09/802,790

(22) Filed: Mar. 8, 2001

(65) Prior Publication Data

US 2002/0034648 A1 Mar. 21, 2002

Related U.S. Application Data

(62) Division of application No. 09/391,028, filed on Sep. 7, 1999, now Pat. No. 6,228,469.

(51) Int. Cl.[7] ..... B32B 15/04; C09K 3/00

(52) U.S. Cl. ..... 428/469; 428/472.2; 428/689; 428/697; 106/2; 106/14.05

(58) Field of Search ..... 428/210, 212, 428/220, 457, 469, 688, 689, 697, 699; 106/2, 14.05, 286.8, 287.17; 156/89.11; 422/241; 208/48 R; 585/950

(56) References Cited

U.S. PATENT DOCUMENTS

| | | | | | |
|---|---|---|---|---|---|
| 3,368,712 | A | * | 2/1968 | Sanford et al. | 428/544 |
| 4,921,738 | A | * | 5/1990 | Cassidy | 428/34.6 |
| 5,153,070 | A | * | 10/1992 | Andrus et al. | 428/408 |
| 5,250,360 | A | * | 10/1993 | Andrus et al. | 428/471 |
| 5,807,616 | A | * | 9/1998 | Trotter, Jr. | 428/34.4 |
| 6,001,494 | A | * | 12/1999 | Kuchinski et al. | 428/653 |
| 6,071,563 | A | * | 6/2000 | Kozlowski et al. | 427/374.7 |

* cited by examiner

*Primary Examiner*—Deborah Jones
*Assistant Examiner*—G. A. Blackwell-Rudasill
(74) *Attorney, Agent, or Firm*—Milton M. Peterson; Vincent T. Kung

(57) ABSTRACT

A metal article, in particular a component for a thermal cracking furnace, and a method of protecting the metal from exposure to carbon, the article having a protective coating that has a glass-ceramic surface and an interior having a CTE between that of the glass-ceramic and the metal.

23 Claims, 1 Drawing Sheet

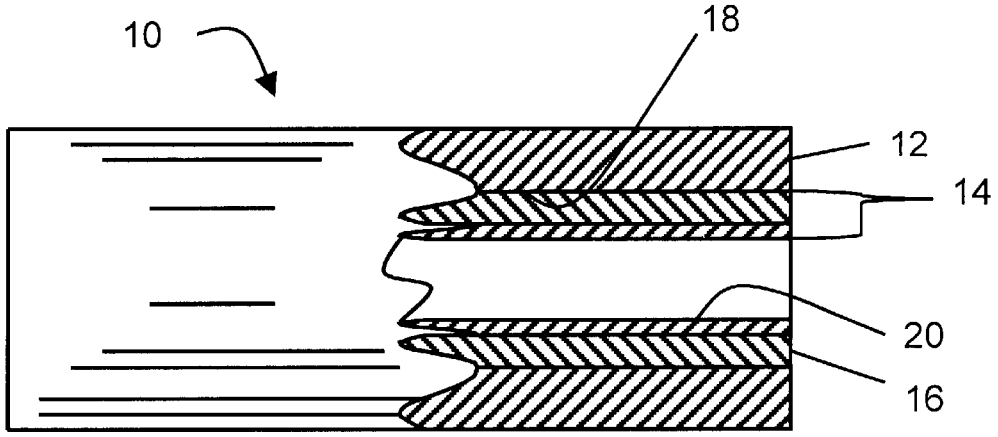
10
18
12
14
20
16

PROTECTIVE COATING ON METAL

This is a division of application Ser. No. 09/391,028 filed Sep. 7, 1999 now U.S. Pat. No. 6,228,469.

FIELD OF THE INVENTION

An inorganic coating on metal, the coating having a plurality of layers with each layer having a different coefficient of thermal expansion (CTE).

BACKGROUND OF THE INVENTION

The protection of metals, particularly alloys, from exposure to carbon at elevated temperatures is encountered in many industrial environments. Two problems commonly encountered are carburization of the metal and carbon buildup on the metal. Both problems are of particular concern in a furnace employed in thermal cracking a stream of hydrocarbons to produce olefins. Therefore, the invention is described with reference to this operation.

At the heart of a thermal cracking process is the pyrolysis furnace. This furnace comprises a fire box through which runs a serpentine array of tubing. This array is composed of lengths of tubing and fittings that may total several hundred meters in length. The array of tubing is heated to a carefully monitored temperature by the fire box.

A stream of feedstock is forced through the heated tubing under pressure and at a high velocity, and the product is quenched as it exits. For olefin production, the feedstock is frequently diluted with steam. The mixture is passed through the tubing array which is commonly operated at a temperature of at least 750° C. During this passage, a carboniferous residue is formed and deposits on the tube walls and fittings.

The carbon deposits initially in a fibrous form. It is thought this results from a catalytic action, primarily due to nickel and iron in the tube alloy. The fibrous carbon appears to form a mat on the tube wall. This traps pyrolitic coke particles that form in the gas stream. The result is buildup of a dense, coke deposit on the tube wall. This carbon buildup is commonly referred to as "coking."

A short range concern is the thermal insulating effect of the carbon buildup on the tube wall. This necessitates continually increasing the fire box temperature to maintain a steady temperature in the hydrocarbon stream passing through the furnace. Ultimately, the fire box and the tube wall reach temperatures where operation must be discontinued. The carbon must then be removed in a procedure referred to as decoking.

A longer range concern is the effect of the carbon on the metal tubes in the cracking furnace. A gradual embrittlement of the metal is observed with consequent loss of mechanical strength. Since the operation is conducted under considerable pressure and tensile load, the danger of tube rupture arises. Both pressure and tensile load tend to be relatively constant factors. However, as a metal tube becomes weak due to embrittlement, these factors become significant. It then becomes necessary to shut the operation down and completely rebuild the furnace with new tubing.

It has been proposed to apply a glass-ceramic coating to a metal surface to protect the metal from embrittlement due to carburization. It has also been proposed to employ a glass-ceramic coating to lessen the tendency for carbon deposition (coking) to occur during a thermal cracking process.

TABLE I sets forth, in weight percent on an oxide basis as calculated from the precursor glass batch, the compositions for several different glass-ceramics ceramics proposed as protective coatings. Examples 1–6 illustrate alkaline earth metal alumino borates or borosilicates. Examples 7–14 illustrate alkaline earth metal silicates which may contain minor amounts of alumina or zirconia.

TABLE I

| | $SiO_2$ | $B_2O_3$ | $Al_2O_3$ | BaO | MgO | CaO | ZnO | $ZrO_2$ | $MnO_2$ | SrO | NiO | F |
|---|---|---|---|---|---|---|---|---|---|---|---|---|
| 1 | — | 19.1 | 27.9 | 42.0 | 11.0 | — | — | — | — | — | — | — |
| 2 | — | 25.4 | 18.6 | 56.0 | — | — | — | — | — | — | — | 6 |
| 3 | 17.5 | 20.2 | 29.7 | — | — | 32.6 | — | — | — | — | — | — |
| 4 | 9.6 | 22.2 | 32.5 | — | — | 35.8 | — | — | — | — | — | — |
| 5 | 30.6 | 12.7 | 3.8 | 15.9 | 23.5 | — | 13.5 | — | — | — | — | — |
| 6 | — | 27.0 | 19.8 | 29.7 | 7.8 | — | 15.8 | — | — | — | — | — |
| 7 | 32.0 | — | — | 40.9 | — | — | — | 8.2 | 18.9 | — | — | — |
| 8 | 33.9 | — | 2.9 | 43.3 | — | — | — | — | 20.0 | — | — | — |
| 9 | 33.2 | 4.8 | — | 42.4 | — | — | — | — | 19.6 | — | — | — |
| 10 | 65.0 | — | 6.9 | — | — | — | — | — | — | 28.1 | — | — |
| 11 | 47.2 | — | — | — | — | — | — | 12.1 | — | 40.7 | — | — |
| 12 | 54.1 | — | 5.7 | — | — | — | — | — | — | 23.3 | 16.8 | — |
| 13 | 38.3 | — | — | — | — | — | — | 5.9 | 22.7 | 33.1 | — | — |
| 14 | 62.7 | — | 5.3 | 32.0 | — | — | — | — | — | — | — | — |

The efficacy of a glass-ceramic coating for these respective purposes was tested on a section of tubing in a thermal cracking furnace. A tendency for sections of the coating to separate from the metal was observed. This undersirable occurrence was thought to be occasioned by an expansion mismatch between the metal and the glass-ceramic coating. The metal was an austenitic metal having a CTE of about $180\times10^{-7}$/° C. (RT-800° C.), whereas the glass-ceramic had a CTE of about $130\times10^{-7}$/° C.

It was recognized that this disparity in CTEs created high compressive stresses in the coating. In accordance with standard enameling experience, would normally be considered desirable. However, the conditions that prevail during operation of a thermal cracking furnace are rather severe. In particular, the furnace undergoes rapid thermal change during a decoking cycle.

It is a purpose of the present invention to provide a solution to the delamination of a glass-ceramic coating from a metal on which it is deposited. Another purpose is to provide a means of promoting adherence of a glass-ceramic coating to a metal body having a high CTE. A further purpose is to provide a component for a thermal cracking furnace that has a glass-ceramic coating in combination with a coating having a higher CTE. Another purpose is to provide an improved method of protecting a metal body with a glass-ceramic coating.

SUMMARY OF THE INVENTION

One aspect of the present invention resides in a metal article having a coating on at least a portion of its surface that protects the metal from contact with carbon, the coating comprising at least an outer portion and an inner portion, the outer portion being a glass-ceramic having a CTE that is substantially lower than that of the metal, and the inner portion being in contact with the metal and having a CTE between that of the outer glass-ceramic portion and the metal.

Another aspect of the invention relates to an improved method of protecting a metal surface that is exposed to contact with carbon by applying a layer of glass-ceramic over the exposed, metal surface, the glass-ceramic layer having a CTE substantially lower than that of the metal, the improvement comprising applying at least one compatible coating between the metal and the glass-ceramic, the coating having a CTE between that of the metal and the glass-ceramic.

BRIEF DESCRIPTION OF THE DRAWINGS

The single FIGURE in the accompanying drawing is a side view of a tubular, metal body with a section removed to show an internal coating in accordance with the present invention.

DESCRIPTION OF THE INVENTION

As noted earlier, it has been proposed to use a glass-ceramic coating to isolate a metal surface from contact with carbon. Bench testing indicated that this approach could alleviate both the occurrence of metal embrittlement and that of carbon buildup. However, actual testing, under operating conditions in a thermal cracking furnace, revealed a problem with adherence of the coating to the metal.

Sections of the coating tended to separate from the wall of the furnace tube at some point in the operation. This, of course, left the tube wall exposed and nullified any positive effect of the coating. It was theorized that this undesirable occurrence might be occasioned by the expansion mismatch between the tube metal and the glass-ceramic coating.

The present invention arose from experiments designed to first determine the cause of the coating non-adherence, and second, to test a possible remedy. X-ray diffraction studies, made on test pieces, indicated stress values as high as 60,000 psi could develop in a coating under operating conditions.

It was thought that, if unduly high, compressive stress values were the cause of the separation, then a multilayer, graded seal approach might alleviate the problem. This approach would provide layers in which the mismatch between successive layers would be reduced to lower values. The next problem was to find a material that would be-compatible with both the metal of the tube and the glass-ceramic used as a coating. The material would also have to provide an expansion coefficient between that of the metal and that of the glass-ceramic.

It has been found that a workable solution to the problem can be obtained by pulverizing the glass-ceramic. The glass-ceramic powder thus produced is mixed with a powdered metal. The proportions of glass-ceramic and metal are selected to provide a desired CTE. For example, with a metal powder having a CTE approximating that of the tube metal to be coated, a mixture of equal volume percentages can be employed. The mixture is then applied as a coating on the interior surface of the tube.

Another possibility is to produce a coating in which the proportions of glass-ceramic and metal change as the coating is applied. This provides a continuous gradient between the metal surface and the exposed surface of the coating.

The choice of metal for the mixture to form the layer is important. The basic requirement is that the composite CTE of the interlayer lie between that of the metal substrate, and that of the glass-ceramic coating. It is also important that the metal chosen be capable of forming a good bond to the glass-ceramic material. Additionally, the metal should be sufficiently refractory to withstand the thermal cycle used to fire the multilayer coating in place, that is, at temperatures up to 1200° C. It would also be desirable for the metal to resist excessive oxidation during the firing process. However, use of a neutral atmosphere, such as argon, can overcome this problem if necessary.

Some advantage may be obtained by partially sintering a thin coat of the metallic filler particles. The metal particles may either be sintered with each other, or to the metal substrate. In this way, better mechanical interlocking of the coating to the substrate may be achieved.

The invention is further described with reference to the single FIGURE in the accompanying drawing. The drawing is a front elevation side view of segment 10 of a reactor tube for use in a thermal cracking furnace in accordance with the invention. Such a reactor tube may be up to 12 meters (40 feet) in length. It may have a diameter as small as 2.5 cm. (1 inch) or as large as 20 cm (8 inches). Segment 10 comprises a cast alloy tube 12 having a dual-layer coating 14 formed on its inner surface.

Dual-layer coating 14 comprises an initial layer 16 adherent to the inner surface 18 of metal alloy 12. A second layer 20 overlays initial layer 16. Layer 20 may be 100% glass-ceramic having a CTE of about $130\times10^{-7}$° C. Layer 16 may be a mixture of the glass-ceramic and a metal, the mixture having a CTE, for example, of about $150–160\times10^{-7}$/° C.

It will be appreciated that a thermal cracking furnace will comprise a serpentine array of tubes and fittings, such as elbows. It is contemplated that a complete cracking furnace, including reactor tubes and fittings, will be coated in accordance with the invention. However, short lengths of tubing may be coated and joined, as by welding.

The effectiveness of the inventive, multilayered coating was determined by a simulated testing procedure. This testing procedure subjected a coated, metal substrate to a series of consecutive temperature cycles. During the test, the test piece was exposed to an atmosphere designed to be similar to that existent in a hydrocarbon cracking furnace.

The test consisted of providing a bed of powdered carbon in an enclosure. Test pieces were placed both within the packed, powdered carbon and on a refractory shelf above the carbon within the enclosure. A continuous stream of wet forming gas was introduced into the enclosure and percolated through the carbon. The entire assembly was thermally cycled from room temperature to 1000° C. in two hours, held at that temperature for three hours, and cooled to 2000° C. in five hours. This thermal cycle was repeated twelve times during a five-day period. The test piece was then removed, cooled and immersed in water to test adherence.

The coating mixture was prepared from a powdered barium silicate glass-ceramic and nickel metal powder. The glass-ceramic had the composition of Example 14 in TABLE I. It had principal crystal phases of sanbornite and crystobalite. It had a CTE of about $130\times10^{-7}$/° C. (0–800° C.). It was prepared by fully ceramming a precursor glass of the same composition at about 1050° C. for about four hours. The nickel metal powder was in the form of spherical particles of 10 microns average size. It was supplied by Novamet, 681 Lawlins Road, Wyckoff, N.J. 07481.

The nickel powder and the glass-ceramic powder were mixed in equal volume amounts. A layer of the mixture was deposited on a metal substrate coupon. The coupon had a thickness of about 1.0 cm (0.4 inches), and was cut from an HP-45 alloy pipe of the type used in a thermal cracking furnace. The mixture was applied by spraying to form a layer having a green thickness of about 0.08 cm (0.032 inches).

A second layer, composed entirely of the glass-ceramic powder, was then sprayed on the first layer to form a layer of about 0.095 cm (0.038 inches). The dual layer thus formed, having a total thickness of about 0.17 cm (0.07 inches), was then sintered to form an adherent, rigid coating on the metal surface.

A comparison test piece was prepared in similar manner, but having a single layer of 100% glass-ceramic. The two test pieces were then subjected together to the five-day cycling procedure described above.

Following this procedure, both test pieces were cooled and immersed in water at room temperature. The test piece, having the mixture of metal and glass-ceramic as an intermediate layer, remained intact. That is, the coating did not separate from the metal. In contrast, the test piece, with the single layer of 100% glass-ceramic did incur flaking off, and did separate from areas of the metal surface. Presumably, this was the result of the wide difference in expansion coefficients between the metal and the glass-ceramic.

In addition to the use of nickel metal powder, as just described, a series of other powdered materials were tested. These included chromic oxide, chromium metal, iron aluminide ($Fe_3Al$) and an alloy composed of 70% Fe-25% Cr-5% Al. Of these, the iron aluminide showed the most promise. Accordingly, a series of test pieces were prepared using this material in powder form as an additive. This material, reportedly, has a CTE of about $198\times10^{-7}$/° C. (25–700° C.).

In one test, powdered $Fe_3Al$ was obtained from Ametek, Specialty Metal Products Division. Thirty-five (35) grams of this material, having a density of 6.59, were mixed with 65 grams of each of two different, powdered glass-ceramics (Examples 12 and 14 in TABLE I). The mixtures were, on a volume basis, 20% metal and 80% glass-ceramic.

Each mixture was blended dry, and then mixed with a binder and dispersant. The resulting mixtures were further blended by rolling in jars. Two coupons of HP-45 alloy were coated with each mixture by spraying. A subsequent layer of undiluted glass-ceramic was applied over each initial coating to form a dual-layer coating.

The thicknesses of the initial green coatings of metal and frit powders were respectively, 0.0725, 0.055, 0.060 and 0.045 mms. (2.9, 2.2, 2.4, $1.8\times10^{-4}$ inches). The thicknesses of the dual-layer coatings were, respectively, 0.235, 0.240, 0.2325 and 0.2175 mms. (0.0094, 0.0096, 0.0093 and 0.0087 inches).

The dual coated test pieces were fired on a standard ceramming schedule to convert the powdered glass to a glass-ceramic state. The test pieces showed slight edge spalling after the ceramming process. The test pieces were then placed in boiling water and held there for 30 minutes. When removed and cooled, they exhibited no further spalling.

As a final test, the test pieces were positioned in a container and packed with charcoal as described earlier. A continuous stream of forming gas was passed through hot water and fed into the container. The container and test pieces, while exposed to the flow of forming gas, were subjected to five successive cycles of the following heat treatment:

room temperature to 1000° C. at furnace rate, hold at 1000° C. for two hours, cool at furnace rate to 200° C.

At the end of the five cycles, the samples had only the original, slight edge spalling. The surfaces of the test pieces exhibited signs of minute bubbles. Test pieces similarly prepared with a single coating of undiluted glass-ceramic exhibited considerable delamination.

We claim:

1. A metal article having a protective coating, the coating comprising a plurality of layers, in which each layer is formed of a glass-ceramic and metal mixture in variable proportions, such that across the plurality of layers the respective content of a glass-ceramic component is inversely proportional to that of a metal component, in which each layer has a different coefficient of thermal expansion (CTE), and the plurality of layers creates a continuous CTE gradient between a coated-metal surface of the metal article and an exposed surface of the coating.

2. The metal article according to claim 1, wherein said exposed surface of the protective coating is a layer of essentially glass-ceramic and an intermediate layer has a CTE between that of the glass-ceramic and coated-metal surface.

3. The metal article according to claim 1, wherein immediate to the coated-metal surface, the protective coating is a layer essentially of metal powder with a binder and dispersant at least partially sintered on the coated-metal surface.

4. The metal article according to claim 1, wherein the protective coating is a dual layer coating comprising an outer layer and an inner layer, the outer layer formed of a glass-ceramic material having a CTE lower than that of the coated-metal surface, the inner layer being in contact with the coated-metal surface is composed of a mixture of the glass-ceramic material of the outer layer and a second material having a CTE higher than that of the glass-ceramic material, and the inner layer mixture has a CTE between that of the glass-ceramic material and coated-metal surface.

5. A metal article having a protective coating, the coating comprising a plurality of layers, in which each layer is composed of mixture of a glass-ceramic material and a second material having a CTE higher than that of the glass-ceramic material in variable proportions, such that across the plurality of layers the respective content of a glass-ceramic component is inversely proportional to that of a second material component, in which each layer has a different coefficient of thermal expansion (CTE), and the plurality of layers provides a continuous CTE gradient between a coated-metal surface of the metal article and an exposed surface of the coating.

6. The metal article according to claim 5, wherein the protective coating is a dual layer coating comprising an outer layer and an inner layer, the outer layer formed of a glass-ceramic material having a CTE lower than that of the coated-metal surface, the inner layer being in contact with the coated-metal surface is composed of a mixture of the glass-ceramic material of the outer layer and the second material, and the inner layer mixture has a CTE between that of the glass-ceramic material and the coated-metal surface.

7. The metal article according to claim 5, wherein a layer of the second material is at least partially sintered on the metal article surface to promote adherence of the inner layer.

8. The metal article according to claim 6, wherein said outer layer has a CTE value of about $130\times10^{-7}$/° C. (0–800° C.).

9. The metal article according to claim 6, wherein said inner layer has a CTE value of about $150–160\times10^{-7}/°$ C.

10. The metal article according to claim 5, wherein the second material is nickel, chromic oxide, chromium metal, $Fe_3Al$, or an alloy composed of about 70% Fe-25% Cr-5% Al.

11. The metal article according to claim 10, wherein the second material is nickel, chromium metal, or $Fe_3Al$.

12. The metal article according to claim 5, wherein the second material has a CTE value of about $198\times10^{-7}/°$ C. (25–700° C.).

13. The metal article according to claim 6, wherein the inner layer is composed of a mixture of 80% glass-ceramic and 20% metal materials.

14. A protective coating on a metal article, the protective coating comprises a plurality of layers, each of a mixture of a glass-ceramic material and a second material, the proportions of each material varies continuously from a coated-metal interface of the metal article to an exposed, outer surface of the coating, wherein across the plurality of layers, the coating likewise exhibits a continuous CTE gradient between a coated-metal surface and the outer surface of the coating.

15. The protective coating according to claim 14, wherein said outer surface of the protective coating is a layer essentially of glass-ceramic material and an intermediate layer has a CTE between that of the glass-ceramic material and coated-metal surface.

16. The protective coating according to claim 14, wherein a layer of the second material is at least partially sintered on the coated-metal surface to promote adherence of the inner layer.

17. The protective coating according to claim 15, wherein said outer surface layer has a CTE value of about $130\times10^{-7}/°$ C. (0–800° C.).

18. The protective coating according to claim 15, wherein said intermediate layer has a CTE value of about $150–160\times10^{-7}/°$ C.

19. The protective coating according to claim 14, wherein the second material comprises a metal that forms a bond to the glass-ceramic material, and is refractory enough to withstand thermal cycles up to 1200° C.

20. The protective coating according to claim 14, wherein the second material is nickel, chromic oxide, chromium metal, $Fe_3Al$, or an alloy composed of about 70% Fe-25% Cr-5% Al.

21. The protective coating according to claim 20, wherein the second material is nickel, chromium metal, or $Fe_3Al$.

22. The protective coating according to claim 14, wherein the second material has a CTE value of about $198\times10^{-7}/°$ C. (25–700° C.).

23. The protective coating according to claim 15, wherein said intermediate layer is composed of a mixture of 80% glass-ceramic and 20% metal materials.

* * * * *